US005715983A

United States Patent [19]

Lee

[11] Patent Number: 5,715,983

[45] Date of Patent: Feb. 10, 1998

[54] FIRING MECHANISM FOR A STAPLE GUN

[76] Inventor: Cheng-ho Lee, No. 74, Paokao Rd., Hsintien City, Taipei Hsien, Taiwan

[21] Appl. No.: 729,002

[22] Filed: Oct. 10, 1996

[51] Int. Cl.[6] ..... B25C 1/14

[52] U.S. Cl. ..... 227/9; 227/10

[58] Field of Search ..... 227/9, 10, 11

[56] References Cited

U.S. PATENT DOCUMENTS

| | | | |
|---|---|---|---|
| 4,493,376 | 1/1985 | Kopf | 227/9 |
| 4,598,851 | 7/1986 | Kopf | 227/9 |
| 4,821,938 | 4/1989 | Haytayan | 227/10 |
| 5,114,064 | 5/1992 | Jochum et al. | 227/10 |
| 5,273,198 | 12/1993 | Popovich et al. | 227/10 |

*Primary Examiner*—Scott A. Smith
*Attorney, Agent, or Firm*—Abelman, Frayne & Schwab

[57] ABSTRACT

A firing mechanism for a staple gun is configured so that a user is able to use an extension rod as a media to activate the ignition of gun powder, wherein a firing pin receives a linear force transferred by the extension rod and reacts in a same direction as the force. After the ignition of the gun powder, the firing pin will be pushed back by an internal energy received by the mechanism when the external force of the extension rod is being applied. Accordingly, the mechanism is again ready for a next firing cycle.

2 Claims, 4 Drawing Sheets

FIRING MECHANISM FOR A STAPLE GUN

FIELD OF THE INVENTION

The present invention generally relates to a firing mechanism, and more particularly to a firing mechanism which is used in a staple gun for firing a staple into an object positioned at a higher level to rigidly fix the object with other object(s).

BACKGROUND OF THE INVENTION

Staple guns have been widely used in a field of interior decoration. The staple gun, for example, is used to fire staples into ceilings to fix frameworks for suspending the ceilings rigidly with concrete walls or with other decorations. The structure of conventional staple gun is very much similar to that of a pistol, which uses a triggering member to control the explosion of gun powder, so that a piston is able to be pushed forward to engage with a staple received within a sleeve formed with a barrel of the staple gun and thus transfers the thrust of the explosion of the gun powder to project the staple out of the barrel. Staple guns of this type sometimes have to incorporate extensions to have the capability to project staples into ceilings and then use a cord to control the triggering member to ignite the gun powder. This design indeed solves many problems yet, because the triggering mechanism of the staple gun is not co-axially formed with the sleeve, therefore, when firing the staple into the ceiling by a user pulling down the cord to control the triggering member, it will be very difficult for the user to aim at the target which is needed to be stapled especially when recoil i produced due to gun powder being ignited.

From the previous description, it is noted that prior staple guns can not fulfill the requirements and standards of the modern society, and need to be improved.

Thus, a staple gun constructed in accordance with the present invention tends to mitigate and/or obviate the aforementioned problems.

SUMMARY OF THE INVENTION

The main objective of the invention is to provide a firing mechanism for a staple gun. The new firing mechanism includes a firing pin having a control block with an arcuate upper face and a first spring therein, a tubular seat for receiving a rear portion of the firing pin, an inner tube enclosing the firing pin and the tubular seat therein, a connector threadingly connected with a rear portion of the tubular seat and protruding out of the tubular seat, an assembling seat threadingly connected with a rear portion of the inner tube and having a first space therein thereby allowing linear movement of the connector within the first space, a firing sleeve threadingly connected with a front portion of the tubular seat and a second spring received within the tubular seat and urged against the connector.

Another objective of the invention is to provide a staple gun using an extension rod to push the connector and therefore activating the movement of the firing pin and causing the explosion of gun powder, which will not produce any recoil to the staple gun during the firing process.

Still another objective of the invention is to provide a first spring and a second spring respectively received within the firing pin and the tubular seat. The first spring will provide a recovery force to the control block after the control block is pressed downward into a recess defined within the firing pin and the second spring will also provide a recovery force to the tubular seat after the tubular seat is pushed toward the firing sleeve to initiate the firing process.

Other objects, advantages and novel features of the invention will become more apparent from the following detailed description when taken in conjunction with the accompanying drawings.

BRIEF DESCRIPTION OF THE DRAWINGS

The present invention will now be better understood with reference to the following drawings, wherein.

DETAILED DESCRIPTION OF THE PREFERRED EMBODIMENT

Figure 1:
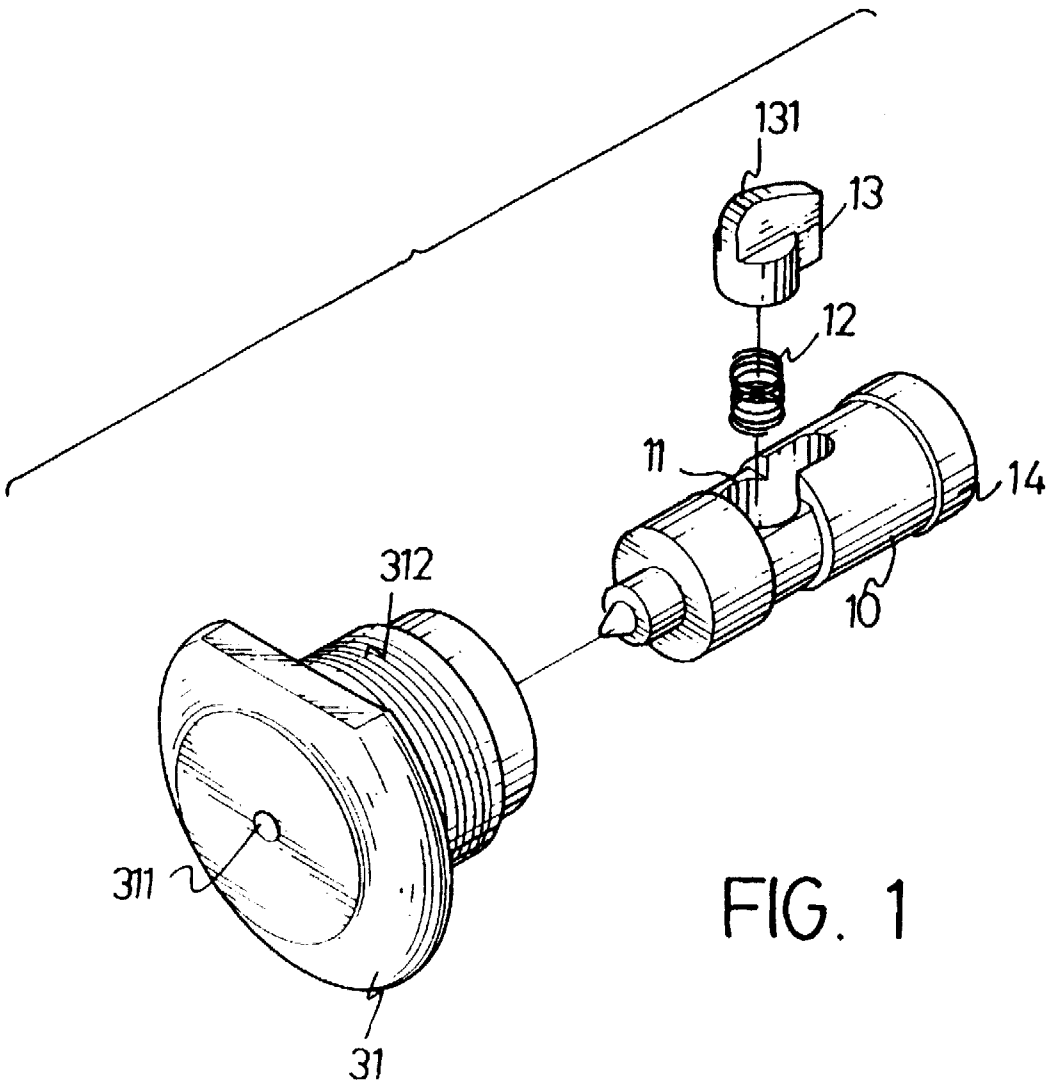
FIG. 1 is an exploded view of a firing pin constructed in accordance with the present invention.

Referring to FIG. 1, a firing pin 10 and a firing sleeve 31 of a staple gun constructed in accordance with the present invention are shown. The firing pin 10 includes a control block 13, a first spring 12 urging against a bottom portion of the control block 13 and a recess 11 defined therein for receiving the control block 13 and the first spring 12 therein. The firing pin 10 further has a first annular flange 14 integrally formed at a rear edge thereof. The firing sleeve 31 includes a tubular extension 312 and an annular head (not numbered) integrally formed with the tubular extension 312 and having a hole 311 therein for communicating with an inner space of the tubular extension 312. It is to be noted from FIG. 2 that the inner space of the tubular extension 312 of the firing sleeve 31 is configured to receive the firing pin 10 therein and that the firing pin 10 is not able to be inserted into the firing sleeve 31 when the control block 13 is not compressed into the recess 11 thereby allowing the firing pin 10 to be inserted into the hole 311 while the control block 13 is pressed into the recess 11 of the firing pin 10.

Figure 2:
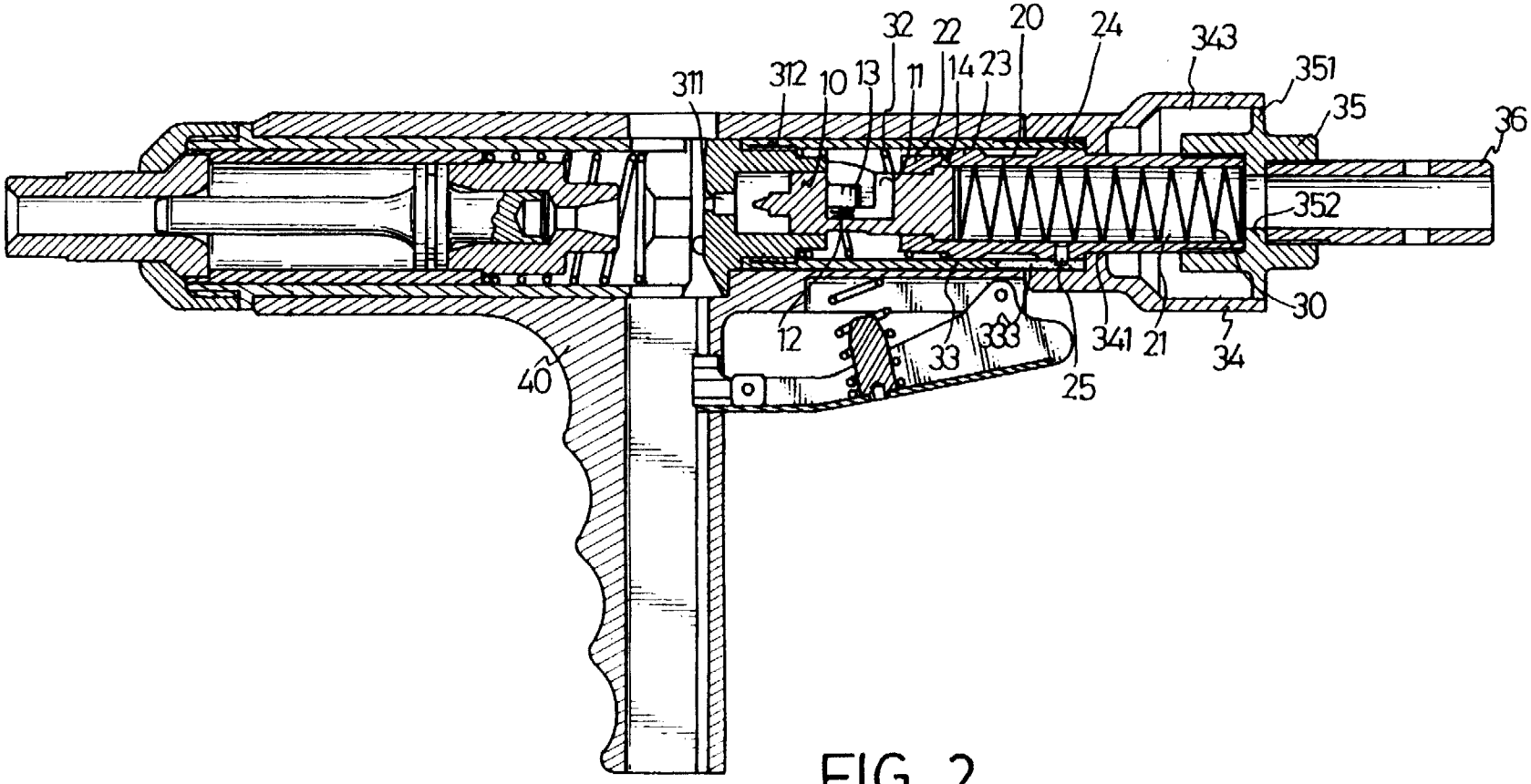
FIG. 2 is a cross sectional view of a staple gun showing the relative positions of all elements of a firing mechanism assembled within the staple gun.

Referring to FIG. 2, a staple gun having a firing mechanism constructed in accordance with the present invention is shown. The firing mechanism includes the firing pin 10 having the control block 13 and the first spring 12 received within the recess 11 defined therein, a tubular seat 20 securely connected with a rear portion of the firing pin 10 and having a chamber 21, a second flange 22, a third flange 23, a fourth flange 24 integrally formed therewith and a pin 25 integrally formed on an outer periphery thereof, an inner tube 33 enclosing the firing pin 10 and the tubular seat 20 therein and threadingly connected with a rear portion of the firing sleeve 31 and having a slot 333 for reciprocatingly receiving the pin 25 of the tubular seat 20 therein, a connector 35 threadingly connected with a rear portion of the tubular seat 20 and having an outer flange 351 and an inner flange 352, an assembling seat 34 threadingly connected with a rear portion of the inner tube 33 and movably connected with the outer flange 351 of the connector 35, thereby allowing linear movement of the connector 35 within a first space 343 defined integrally therewith, a firing sleeve 31 threadingly connected with a front portion of the tubular seat 20 and a second spring 30 received within the chamber 21 of the tubular seat 20 and confined therein by the inner flange 352 of the connector 35 and a rear face of the firing pin 10 when the connector 35 is threadingly connected with the rear portion of the tubular seat 20. The second flange 22 of the tubular seat 20 is configured to mate with the annular first flange 14 of the firing pin 10 and the third flange 23 incorporates with the firing sleeve 31 to confine a third spring 32 therebetween. An annular shoulder 341 of the assembling seat 34 is formed to mate with the fourth flange 24 of the tubular seat 20 to provide a stop-effect to the tubular seat 20. The outer flange 351 of the connector 35 slidably connects with an inner peripheral face of the assembling seat 34 and the inner flange 352 provides a base (not numbered) for the second spring 30 to abut thereagainst. An extension rod 36 is securely connected to the connector 35.

Figure 3:
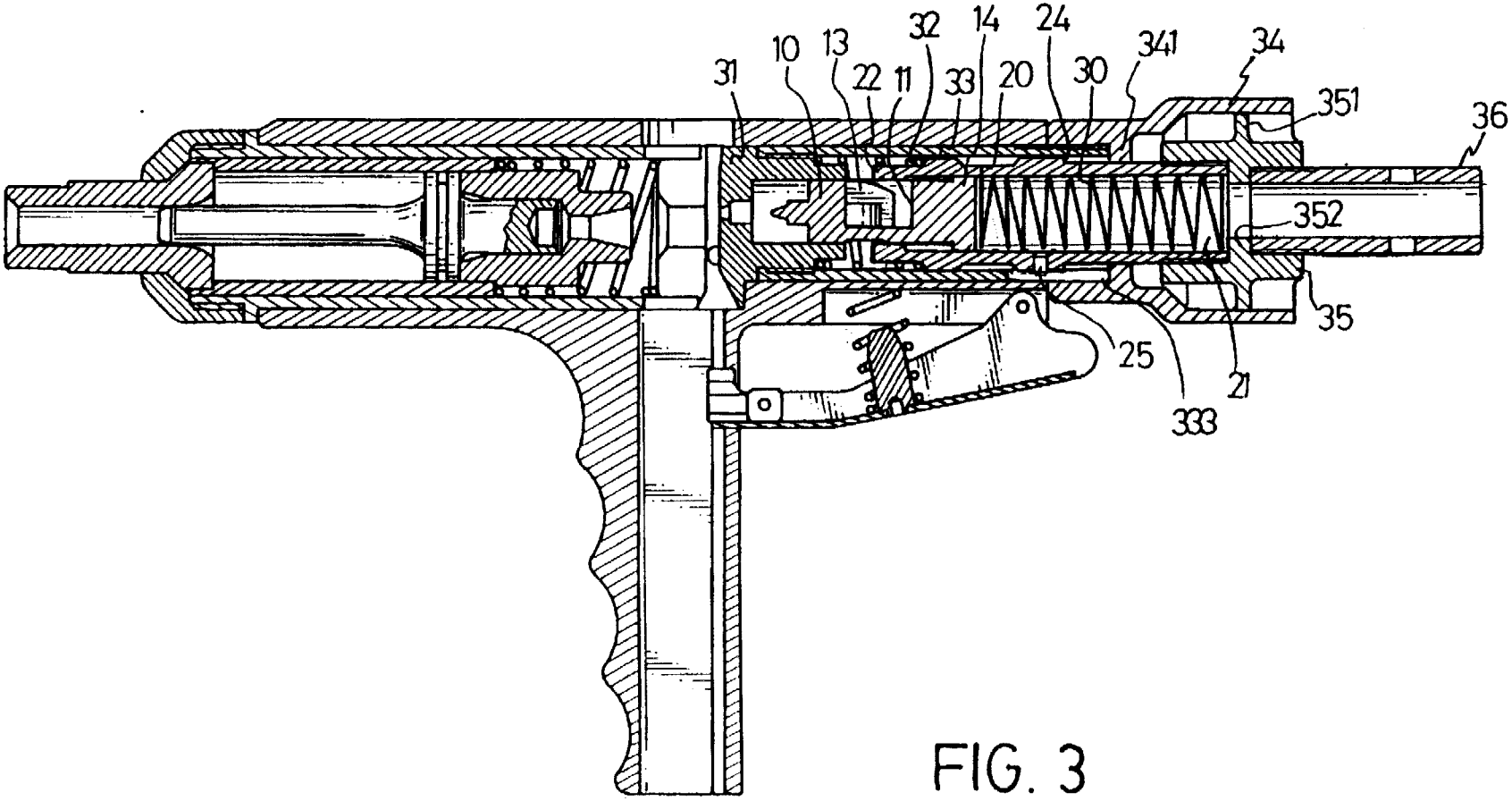
FIG. 3 is still another cross sectional view of FIG. 2, yet a control block received within the firing pin is being pressed inward into a recess defined within the firing pin by a movement of a connector and a first spring and a second spring are compressed.
Figure 4:
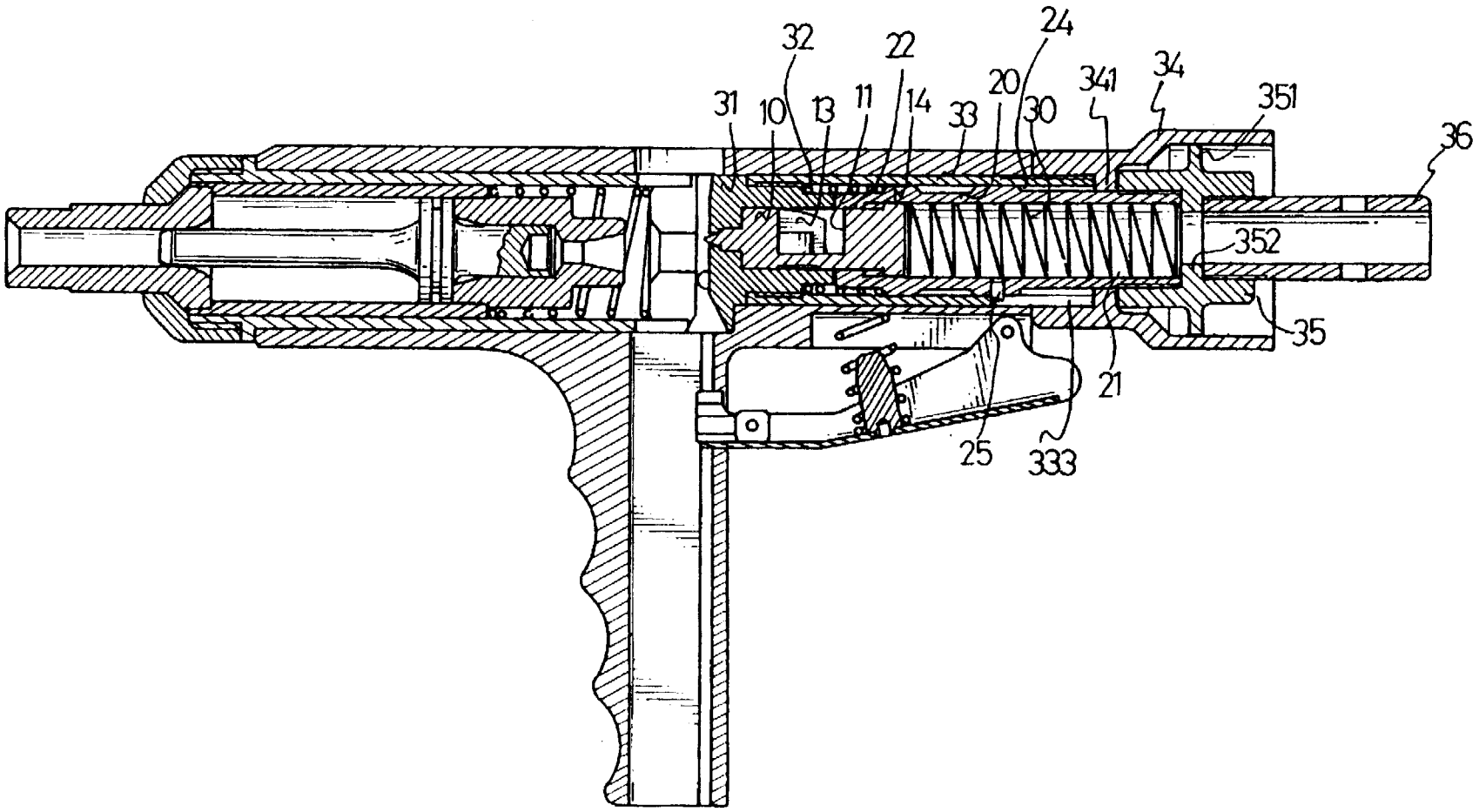
FIG. 4 is a further cross sectional view of FIG. 2 wherein the firing pin is pushed into a firing sleeve by the resilience of the compressed second spring.

Referring to FIGS. 3 and 4, when the staple gun having the firing mechanism constructed in accordance with the present invention therein is in operation, the extension rod 36 is first pushed toward the inner flange 352 of the connector 35, and because the connector 35 is slidably received within the assembling seat 34, the connector 35 along with the second spring 30 will also be pushed inward. Due to the abutment between the second flange 22 of the tubular seat 20 and the first annular flange 14 of the firing pin 10, and the abutment between the control block 13 of the firing pin 10 and the firing sleeve 31, and the confinement of the second spring 30 between the inner flange 352 of the connector 35 and the rear portion of the firing pin 10, while an external force is exerted directly onto the inner flange 352 of the connector 35 and causes the second spring 30 to be in compression, the firing pin 10 will still remain stationary. Additionally, when the second spring 30 is being compressed by the force applied by the extension rod 36, the third spring 32 confined between the third flange 23 of the tubular seat 20 and the firing sleeve 31 will also be compressed. It is to be noted that the control block 13 defines an arcuate upper face 131, such that the control block 13 will be forced to descend to the recess 11 defined within the firing pin 10 when an external force applied by an user is exerted thereon. Therefore, taking FIG. 4 as reference, if the external force keeps on exerting on the inner flange 352 of the connector 35, the control block 13 will then gradually descend to the recess 11 of the firing pin 10. After the control block 13 is entirely received within the recess 11 of the firing pin 10, the firing pin 10 will no longer be limited and is free to move linearly within the firing sleeve 31 toward the hole 311 due to the resilience of the compressed second spring 30 and activates the ignition of the gun powder compacted within a cartridge (not shown) adjacent to the firing sleeve 31. When the firing pin 10 is pushed forward to activate the ignition of the gun powder by the second spring 30, the third spring 32 will also be compressed by the resilience force of the second spring 30. After the explosion, the resilience force of the third spring 32 will then push the tubular seat 20 along with the firing pin 10 back to the assembling seat 34 until the fourth flange 24 of the tubular seat 20 abuts the annular shoulder 341 of the assembling seat 34. Meanwhile, the second flange 22 of the tubular seat 20 will also abut the first annular flange 14 of the firing pin 10 and therefore pulls the firing pin 10 out of the firing sleeve 31. The control block 13 of the firing pin 10 then again abuts the rear portion of the firing sleeve 31 and is ready for a next cycle of explosion.

A structure of this type will not cause either failure in aiming at a target or injury to a user. Thus, the firing mechanism of a staple gun constructed in accordance with the present invention indeed has novelty and improvement when compared with prior art.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A firing mechanism for a staple gun comprising a firing pin configured to define a recess, a first spring received within said recess, a control block securely urged by one end of said first spring and a first annular flange formed therewith;

a firing sleeve having a tubular extension movably urged against said control block of said firing pin and an annular head formed with said tubular extension and defining a hole therein;

a tubular seat having a second flange securely mated with said first annular flange of said firing pin, a third flange, a fourth flange, a chamber and a pin integrally formed on an outer periphery thereof;

a connector securely connected with a rear portion of said tubular seat and having an outer flange and an inner flange;

a second spring received within said chamber of said tubular seat and confined between said inner flange of said connector and a rear face of said firing pin;

an inner tube securely connected with a rear portion of said firing sleeve and enclosing said firing pin and said tubular seat therein, said inner tube further defines a slot for receiving said pin of said tubular seat;

an assembling seat securely connected with a rear portion of said inner tube and movably connected to said outer flange of said connector and having an annular shoulder abutted to said fourth flange of said tubular seat;

a third spring securely confined between said firing sleeve and said third flange of said tubular seat.

2. The firing mechanism as claimed in claim 1, wherein an upper face of said control block is configured to be arcuate.

* * * * *